United States Patent [19]

Ferguson, Jr.

[11] Patent Number: 4,794,814

[45] Date of Patent: Jan. 3, 1989

[54] MECHANICAL STOP

[75] Inventor: Milton T. Ferguson, Jr., Ridgefield, Conn.

[73] Assignee: The Perkin-Elmer Corporation, Norwalk, Conn.

[21] Appl. No.: 50,804

[22] Filed: May 18, 1987

[51] Int. Cl.[4] ..... G05G 1/04

[52] U.S. Cl. ..... 74/526; 74/527

[58] Field of Search ..... 74/526, 10.2, 527; 292/216

[56] References Cited

U.S. PATENT DOCUMENTS

| | | | |
|---|---|---|---|
| 533,694 | 2/1895 | Wilson . | |
| 1,899,250 | 2/1933 | Wheebarger et al. . | |
| 2,780,941 | 2/1957 | Kollmorgen . | |
| 2,858,707 | 11/1958 | Langridge et al. | 74/526 X |
| 3,012,447 | 12/1961 | Wallace | 74/10.2 |
| 3,147,629 | 9/1964 | Michalec . | |
| 3,203,262 | 8/1965 | Beer | 74/526 X |
| 3,546,409 | 12/1970 | Robbins | 74/565 |
| 3,578,368 | 5/1971 | Dupuis | 292/216 |
| 3,896,681 | 7/1975 | Boyle | 74/526 |
| 4,110,802 | 8/1978 | Ho et al. | 74/526 |
| 4,183,257 | 1/1980 | Lovenduski | 74/526 |
| 4,444,072 | 4/1984 | Grimes et al. | 74/526 |

FOREIGN PATENT DOCUMENTS

| | | | |
|---|---|---|---|
| 1072790 | 1/1960 | Fed. Rep. of Germany | 74/527 |
| 544620 | 2/1956 | Italy | 74/526 |
| 45-28136 | 9/1970 | Japan | 74/526 |
| 759053 | 10/1956 | United Kingdom | 74/526 |
| 791104 | 2/1958 | United Kingdom | 74/526 |

*Primary Examiner*—Richard E. Moore
*Assistant Examiner*—Vinh Luong
*Attorney, Agent, or Firm*—Thomas P. Murphy; Edwin T. Grimes; Paul A. Fattibene

[57] ABSTRACT

A mechanical stop permitting rotation of more than one revolution, but less than two revolutions. A wheel having a pin attached is rotated about an axis. A pair of pivoting flip-flops each having two perpendicular legs is placed in the path of the pin. The pin, after passing each flip-flop, flips the flip-flop into a stop position from an initial pass position. This permits the pin to pass each flip-flop only once during rotation in one continuous direction. The flip-flop spacing determines the distance beyond one revolution the wheel is permitted to travel. The flip-flops reset each time the wheel reverses direction.

9 Claims, 2 Drawing Sheets

MECHANICAL STOP

FIELD OF THE INVENTION

This invention relates generally to mechanical stops for rotating device and more particularly to a mechanical stop permitting rotation of more than one revolution, but less than two revolutions.

BACKGROUND OF THE INVENTION

There are many mechanical devices in which travel must be limited by mechanical stops. Accordingly, there are many mechanical stops for varying applications. These mechanical stops range from very simple to very complex. As with most mechanical devices the simpler the structure the more reliable the device. Therefore, the simpler the mechanical stop the more reliable the stop will be. A simple door check is disclosed in U.S. Pat. No. 533,694 issued to Wilson on Feb. 5, 1895. In this patent a pivoting angular or L-shaped member is disclosed in which a door is held open by one of its legs.

More complex stops were necessitated when the stopping requirements became more complex. This is especially true in the stops used to limit rotation. Stops exist to limit rotation after one, two, or multiple revolutions. One such stop limiting rotation after two revolutions is disclosed in U.S. Pat. No. 2,780,941 entitled "Multiple Revolution Limit Stop Device" issued to Kollmorgan on Feb. 12, 1957. This patent discloses concentric sleeves having a space containing a ball therein. The ball being recessed in a peripheral groove is permitted to rotate within the space between the concentric sleeves. A pin or lug is affixed to each sleeve which extends into the space and interacts with the ball to limit relative rotation of the sleeves to slightly less than two revolutions.

Another two revolution mechanical stop is disclosed in U.S. Pat. No. 3,012,447 entitled "Two-Revolution Mechanical Stop" issued to Wallace on Dec. 12, 1961. This patent discloses a rotating disk containing a tooth on the periphery. The disk when rotated contacts a two tooth rotatably mounted pivot stop. As the disk rotates its tooth will engage the pivot stop and cause the pivot stop to rotate in the direction of the movement of the disk bringing the second tooth into a vertical position. As the disk makes a second revolution and strikes the second upwardly extending tooth the disk will be prevented from continuing its rotation. In this way the disk is limited to two revolutions. This device can not be adjusted to provide varying rotation between one and two revolutions.

Other devices have been described providing a mechanical stop after multiple turns. The mechanical stops which provide for more than two revolutions are generally complex. For example, U.S. Pat. No. 1,899,250 entitled "Full Stroke Mechanism" issued to Wheelbarger et al on Feb. 28, 1933 and U.S. Pat. No. 3,147,629 entitled "Multiturn Stop" issued to Michalec on Sept. 8, 1964.

While all of these stops have contributed to advancements in the art none can adequately address the situation where more than one but less than two revolutions are needed. It is therefore necessary to turn away from the teachings of the prior art and establish a new and innovative approach to the construction of a mechanical stop.

SUMMARY OF THE INVENTION

The present invention is directed to a simple mechanical stop permitting predetermined rotation between one and two revolutions. This is accomplished by a wheel having a pin mounted thereon. When the wheel is rotated the pin strikes a first flip-flop in an initial pass position setting the flip-flop to a stop position. Prior to one complete revolution the pin strikes a second flip-flop in an initial pass position. The pin continues to travel past one complete revolution until it strikes the first pin a predetermined distance away now set in a stop position. The wheel and pin assembly have now traveled more than one complete revolution, but less than two revolutions. The spacing of the first and second flip-flops determines at what point the wheel and the pin assembly will be stopped after the first full revolution and partial second revolution.

Accordingly, it is an objective of the present invention to provide a mechanical stop capable of rotating more than one complete revolution, but less than two revolutions.

It is an advantage of the present invention that this objective is met by a secure and simple mechanical stop.

It is a feature of the present invention that a pair of flip-flops are used spaced a predetermined distance apart.

These and other objects, advantages, and features will become readily apparent in view of the following more detailed description.

DETAILED DESCRIPTION OF THE PREFERRED EMBODIMENT

Figure 1:
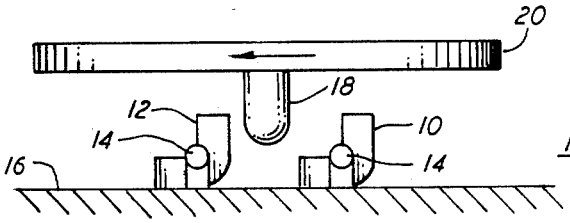
FIG. 1 is a front elevational view of the invention.

FIG. 1 illustrates the present invention comprising a wheel 20 mounted over a base 16. The wheel 20 rotates about a central axis (not shown). Pin 18 extends perpendicular to the plane of wheel 20. Pin 18 is located a predetermined radial distance from the axle of wheel 20. On base 16 is mounted a pair of brackets 14. A first flip-flop or angled member 10 is pivotally attached to one of the pair of brackets 14. A second flip-flop or angled member 12 is pivotally mounted on the other bracket 14. First flip-flop 10 and second flip-flop 12 are positioned so that contact is made with pin 18 when wheel 20 is rotated.

Figure 2:
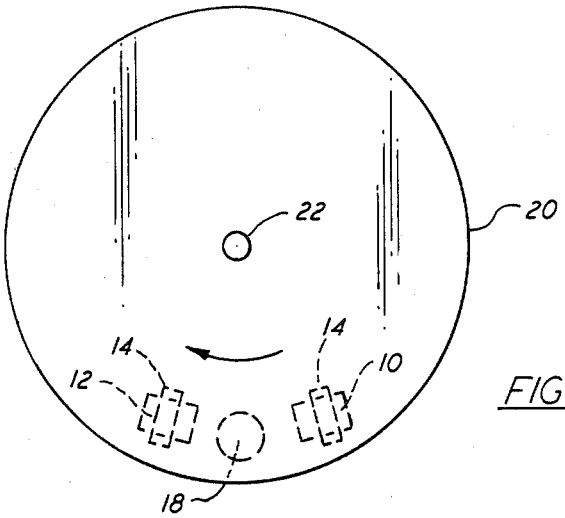
FIG. 2 is a plan view of the invention.

In FIG. 2 wheel 20 and its association with flip-flops 10 and 12 are more easily seen. Wheel 20 rotates around axle or shaft 22. Pin 18 is attached to wheel 20 at a predetermined radial distance from axle or shaft 22. This radial distance is determined by the position of flip-flops 10 and 12. The radial distance is selected so that pin 18 will engage flip-flops 10 and 12 when wheel 20 is rotated. When pin 18 strikes flip-flop 10 or 12 the flip-flop 10 or 12 is flipped into a stop position or flopped into a pass position. Whether or not flip-flops 10 and 12 are in a pass position or a stop position is relative to the direction of rotation of wheel 20.

Figure 3A:
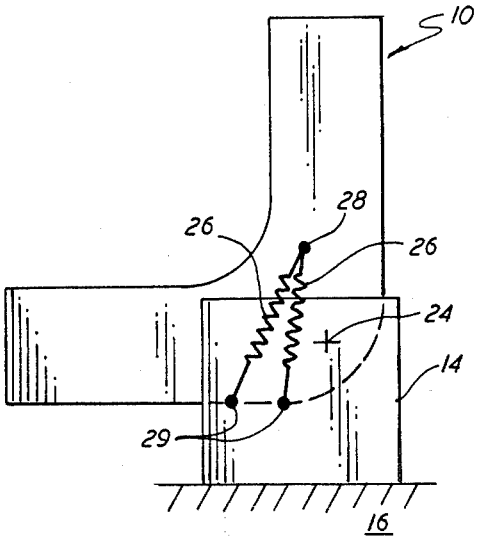
FIGS. 3 *a–b* are a detailed front elevational view of one of the flip-flops.
Figure 3B:
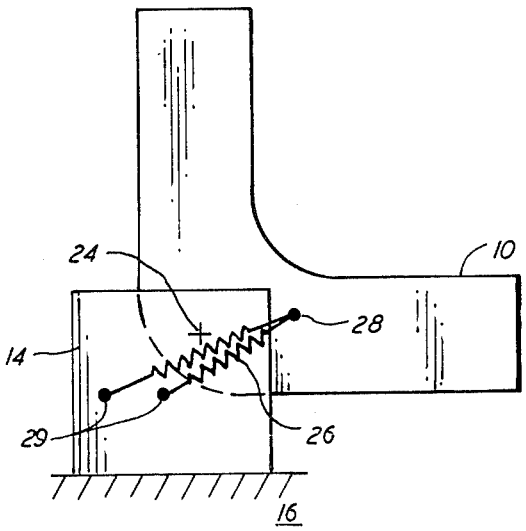

FIG. 3*a* shows a more detailed view of flip-flop 10. Flip-flop 12 is constructed similarly to flip-flop 10. FIG. 3 shows a bracket 14 attached to the base 16. Flip-flop or angled member 10 is pivotally mounted to bracket 14 by pivot 24. Flip-flop 10 can be made of a rigid material, or a resilient material, such as rubber, so that some of the shock of the striking pin 18 is absorbed. Other well known shock absorbing means can be used. On each leg of flip-flop 10 is also mounted elastic or spring material 26. The elastic or spring material 26 is anchored at each end by first anchor 28 on the flip-flop 10 and second anchors 29 on the bracket 14. The elastic material 26 helps avoid unintentional flipping of flip-flop 10. The elastic material 26 helps retain flip-flop 10 in an upright position until pin 18 strikes the upright leg such that flip-flop 10 is pivoted clockwise. Elastic material 26 provides an initial resistance to the clockwise rotation of flip-flop 10, but after a certain angle of clockwise movement the elastic material 26 will assist flip-flop 10 to continue rotating clockwise until a second stable position is achieved with the second leg replacing the first leg in an upright position. This second stable position is shown in FIG. 3*b*. This process can be reversed resulting in flip-flop 10 having two stable positions. Other well known resistance or unintentional flipping means can also be used.

Figure 4A:
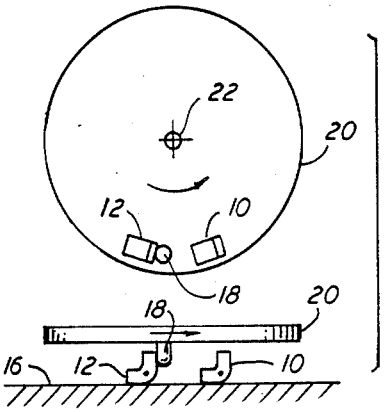
FIGS. 4 *a–e* are a pictorial representation of the operating sequence of the invention.
Figure 4B:
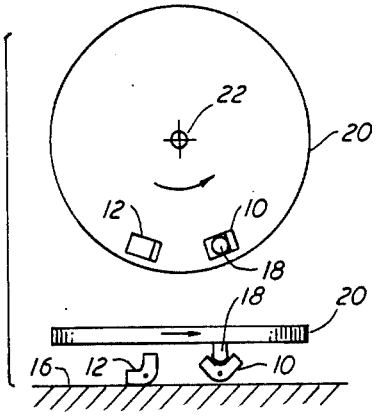
Figure 4C:
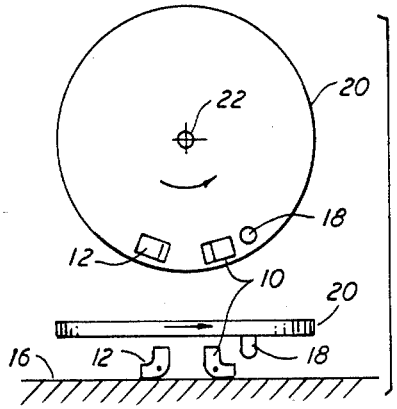
Figure 4D:
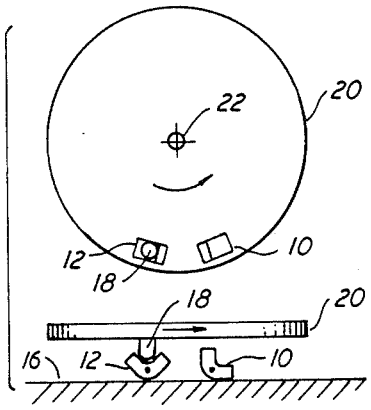
Figure 4E:
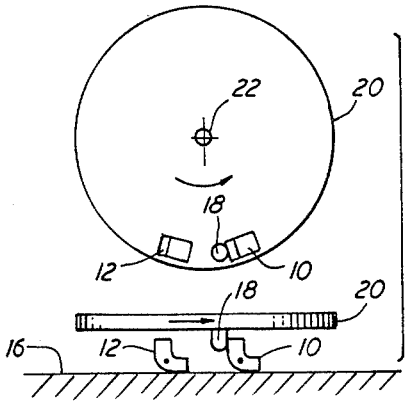

The operation of the device can best be understood with reference to FIGS. 4*a–e*. In FIG. 4*a* the mechanical stop of the present invention can be seen in an initial position. If the wheel 20 is rotated in the direction of the arrow, counterclockwise, flip-flops 10 and 12 are both set in a pass position. Pin 18 is initially positioned adjacent flip-flop 12 at a starting location X. When wheel 20 is rotated counterclockwise pin 18 moves in the direction toward flip-flop 10. As shown in FIG. 4*b*, when pin 18 strikes flip-flop 10 it is flipped into a stop position. As seen in FIG. 4*c*, pin 18 continues to travel in a counterclockwise direction leaving flip-flop 10 in a stop position. Eventually, pin 18 after continuing in a counterclockwise direction strikes flip-flop 12, which was initially set in a pass position, flipping it. This is illustrated in FIG. 4*d*. As the wheel 20 continues its rotation in the counterclockwise direction pin 18 will strike flip-flop 10 for a second time now in a stopping position, as shown in FIG. 4*e*. Pin 18 is then brought to rest adjacent flip-flop 10 at location Y. Pin 18 has now traveled more than one complete revolution from its initial starting location at location X to its final resting location at location Y. By varying the distance between flip-flops 10 and 12 wheel 20 can be selectively stopped between more than one revolution to less than two revolutions.

Flip-flops 10 and 12 are now set in positions to permit the rotation of wheel 20 in a clockwise direction. This results in pin 18 being stopped at location X after more than one revolution of wheel 20. The mechanical stop device of the present invention can be alternately rotated in a clockwise and counterclockwise direction continuously providing more than one complete revolution between stops.

The mechanical stop of the present invention has many practical applications. One such application is in the use of a telescope mounted on wheel 20 when it is necessary for the telescope to scan more than one revolution or more than 360°. This is only one example of the usefulness of the present invention wherein it will be obvious for artisans skilled in other arts to apply the teachings of this invention to their respective arts. Additionally, although the preferred embodiment has been illustrated and described, it will be obvious to those skilled in the art that various modifications may be made without departing from the spirit and scope of this invention.

What is claimed is:

1. A mechanical stop for limiting rotation after more than one, but less than two revolutions comprising:

a rotatable member;

a pin extending from said rotatable member;

a base;

first flip-flop means, attached to said base in a position to contact said pin upon rotation of said rotatable member, for flipping into a stop position when struck by said pin when said rotatable member is rotated in a first direction and for flopping into a pass position when struck by said pin when said rotatable member is rotated in a second direction; and second flip-flop means, attached to said base in a position to contact said pin upon rotation of said rotatable member and separated from said first flip-flop means by an angular distance as measured from the center of said rotatable member equal to the angular rotation desired greater than one revolution, for flipping into a stop position when struck by said pin when said rotatable member is rotated in the first direction and for flopping into a pass position when struck by said pin when said rotatable member is rotated in the second direction.

2. A mechanical stop as in claim 1 further comprising:

resistance means, associated with said first and second flip-flop means, for preventing unintentional flip-flopping of said first and second flip-flop means.

3. A mechanical stop as in claim 2 wherein said first and second flip-flop means each comprise:

an angled member pivotally attached to said base having a first and second leg.

4. A mechanical stop as in claim 3 wherein:

said first leg is perpendicular to said second leg.

5. A mechanical stop as in claim 4 further comprising:

means for absorbing the shock of said pin striking said first and second flip-flop means.

6. A mechanical stop as in claim 5 wherein said absorbing means comprises:

said first and second flip-flop means being made of a resilient material.

7. A mechanical stop for limiting rotation after more than one, but less than two revolutions comprising:

a base;

a first bracket attached to said base;

a first angled member having a first and second leg;

a first pivot pin pivotally attaching said first angled member to said first bracket so that said first angled member alternates between two stable states;

a second bracket attached to said base a predetermined distance from said first bracket;

a second angled member having a third and fourth leg;

a second pivot pin pivotally attaching said second angled member to said second bracket so that said second angled member alternates between two stable states;

a wheel rotating about an axis and mounted adjacent said base; and a pin extending from said wheel perpendicular thereto radially distant from the axis in a position to contact said first and second angled member causing each to alternate between said two stable state when said wheel is rotated about the axis.

8. A mechanical stop as in claim 7 further comprising:

first elastic means, attached to said first angled member, for preventing unintentional flipping of said first angled member; and second elastic means, attached to said second angled member, for preventing unintentional flipping of said second angled member.

9. A mechanical stop as in claim 8 further comprising:

means for absorbing the shock of said pin striking said first and second angled member.

* * * * *